US009124017B2

(12) United States Patent
Shinkawa et al.

(10) Patent No.: US 9,124,017 B2
(45) Date of Patent: Sep. 1, 2015

(54) TERMINAL FITTING

(71) Applicant: Yazaki Corporation, Tokyo (JP)

(72) Inventors: Daisuke Shinkawa, Makinohara (JP); Shogo Suzuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/773,697

(22) Filed: Feb. 22, 2013

(65) Prior Publication Data

US 2013/0165000 A1 Jun. 27, 2013

Related U.S. Application Data

(63) Continuation of application No. PCT/JP2011/069209, filed on Aug. 25, 2011.

(30) Foreign Application Priority Data

Aug. 25, 2010 (JP) ..... 2010-188560

(51) Int. Cl.

| | |
|---|---|
| ***H01R 13/428*** | (2006.01) |
| ***H01R 13/422*** | (2006.01) |
| ***H01R 13/15*** | (2006.01) |
| ***H01R 13/05*** | (2006.01) |
| *H01R 13/627* | (2006.01) |
| *H01R 13/11* | (2006.01) |

(52) U.S. Cl.

CPC ..... *H01R 13/4223* (2013.01); *H01R 13/055* (2013.01); *H01R 13/15* (2013.01); *H01R 13/113* (2013.01); *H01R 13/6272* (2013.01)

(58) Field of Classification Search

USPC ..... 439/852, 595, 871

See application file for complete search history.

(56) References Cited

U.S. PATENT DOCUMENTS

| | | | | |
|---|---|---|---|---|
| 7,147,522 | B2 * | 12/2006 | Kobayashi et al. | 439/852 |
| 7,517,247 | B2 * | 4/2009 | Hiramatsu | 439/595 |
| 7,867,028 | B2 * | 1/2011 | Brown | 439/595 |
| 2006/0063427 | A1 | 3/2006 | Tanaka et al. | |

(Continued)

FOREIGN PATENT DOCUMENTS

| | | |
|---|---|---|
| CN | 1819351 A | 8/2006 |
| CN | 1819353 A | 8/2006 |

(Continued)

OTHER PUBLICATIONS

International Search Report dated Nov. 8, 2011 issued by the International Searching Authority in counterpart International Application No. PCT/JP2011/069209.

(Continued)

*Primary Examiner* — Neil Abrams
*Assistant Examiner* — Travis Chambers
(74) *Attorney, Agent, or Firm* — Sughrue Mion, PLLC

(57) ABSTRACT

A terminal fitting is mounted on a terminal accommodation chamber formed in a connector housing by being engaged with an elastically deformable lance provided in the terminal accommodation chamber. The terminal fitting includes a bite resistance increasing part that is formed only at an upper portion of a hole edge engagement end face of an engaging hole to be engaged with the lance and increases a bite resistance to the lance. An lower portion of the hole edge engagement end face is flat. The bite resistance increasing part has a wave-shaped part that is formed by partially pressing the hole edge engagement end face.

2 Claims, 7 Drawing Sheets

(56) References Cited

U.S. PATENT DOCUMENTS

| | | | | |
|---|---|---|---|---|
| 2006/0172615 | A1 | 8/2006 | Noro et al. | |
| 2006/0172620 | A1 | 8/2006 | Noro et al. | |
| 2008/0070452 | A1 * | 3/2008 | Komiyama et al. | 439/852 |

FOREIGN PATENT DOCUMENTS

| | | | |
|---|---|---|---|
| JP | 55-29020 | U | 8/1980 |
| JP | 5529020 | U | 8/1980 |
| JP | 60-60881 | U | 4/1985 |
| JP | 6060881 | U | 4/1985 |
| JP | 2005259363 | A | 9/2005 |

OTHER PUBLICATIONS

Written Opinion dated Nov. 8, 2011 issued by the International Searching Authority in counterpart International Application No. PCT/JP2011/069209.

Office Action, dated Jan. 17, 2014, issued by the Korean Intellectual Property Office, in counterpart Application No. 10-2013-7004681.

Office Action, Issued by the Korean Intellectual Property Office, Dated Aug. 29, 2014, in counterpart 10-2013-7004681.

Communication dated Jul. 8, 2014, issued by the Japanese Patent Office in counterpart Japanese Application No. 2010-188560.

Office Action dated Sep. 26, 2014 issued by The State Intellectual Property Office Of The People's Republic Of China in counterpart Chinese Application No. 201180040216.5.

Communication dated Mar. 31, 2015 issued by the Korean Intellectual Property Office in counterpart Korean Patent Application No. 10-2013-7004681.

Office Action issued Mar. 3, 2015 in corresponding Japanese patent application No. 2010-188560 with English translation.

Office Action issued on Mar. 25, 2015 in corresponding Chinese patent application No. 201180040216.5 with English translation.

Office Action issued on Jun. 8, 2015 in Korean patent application No. 10-2013-7004681 with English translation.

* cited by examiner

TERMINAL FITTING

CROSS REFERENCE TO RELATED APPLICATION

This application is a continuation of PCT application No. PCT/JP2011/069209, which was filed on Aug. 25, 2011 based on Japanese Patent Applications No. 2010-188560 filed on Aug. 25, 2010, the contents of which are incorporated herein by reference. Also, all the references cited herein are incorporated as a whole.

BACKGROUND OF THE INVENTION

1. Technical Field

The present invention relates to a terminal fitting which is mounted to a terminal accommodation chamber by being engaged with a lance which is elastically deformably provided in a connector housing.

2. Background Art

In order to increase a retaining force of a terminal fitting, a hooking margin of a lance to a front portion of a hole edge of an engaging hole may be increased by increasing a width dimension of the lance. However, since some of the terminal fittings have a stabilizer for stabilizing a posture of the terminal fitting which is projected on a rear end of an outer face of a connection part, there may occur a matter that the lance and the stabilizer are overlapped and interfered with each other when the lance with a large width as described above has substantially the same width over the entire length thereof.

A connector to solve such a problem is disclosed in JP-A-2005-259363, for example. As shown in FIG. 8, in this connector, a stabilizer 509 is projected on an outer face of a connection part 501 and intended to guide an insertion operation of a terminal fitting 507 through an insertion groove 505 provided on an inner wall of a cavity 503. A lance 511 is provided on the inner wall of the cavity 503. The lance 511 is provided with an engaging part 517 and an escape recess part 519. The engaging part 517 can be engaged over the substantially entire width of an engaged face 513 of a protrusion (not shown) and a front part 515 of a hole edge of an engaging hole (not shown), which are provided in the connection part 501. The escape recess part 519 is provided at a portion which is located in the rear of the engaging part 517 and overlapped with the engaging part 517 in a width direction. The escape recess part 519 is communicated with the insertion groove 505 to allow the stabilizer 509 to enter the insertion groove 505.

According to the above configuration, since the engaging part 517 of the lance 511 is engaged over the substantially entire width of the engaged part (the engaged face 513 and the front part 515 of the hole edge of the engaging hole (not shown)) provided in the connection part 501, the terminal retaining force is increased and therefore a structure having a strong shear resistance is achieved. On the other hand, since the lance 511 is provided with the escape recess part 519 which is provided at a portion that is located in the rear of the engaging part 517 and overlapped with the engaging part 517 in a width direction and which is communicated with the insertion groove 505 to allow the stabilizer 509 to enter the insertion groove 505, it is possible to avoid interference between the stabilizer 509 and the lance. Further, since it is not necessary to increase the width of the connection part 501 in order to avoid the interference, it is possible to avoid the increase in size of the connector.

SUMMARY OF THE INVENTION

In a recent connector, there is a problem that a terminal retaining force of a lance is decreased as the compactness of the connector progresses. Since the reduction in size of the lance means the decrease in the retaining force as it is, balance of the compactness and the maintenance of the retaining force has become an issue. In the above related art, in order to deal with the decrease in the retaining force of the lance due the compactness, the engaging part 517 of the lance 511 is engaged over the substantially entire width of the engaged part provided on the connection part 501. In this way, a structure having a strong shear resistance is achieved and the retaining force of the lance is increased.

However, in an engagement area of the terminal fitting and the lance, the lance made of resin is engaged with the engaging hole of the terminal fitting made of metal. Accordingly, even if a large engagement area is ensured, the disadvantage occurs as follows. That is, when an edge of the hole edge engagement end face of the engaging hole is sharp, the sharp edge bites into the lance and thus a shear fracture starting strength of the lance is significantly lowered.

The present invention has been made in consideration of the above situation and an object of the present invention is to provide a terminal fitting which is capable of suppressing the increase of shear fracture of the lance due to compactness, thereby improving the retaining force.

The object of the present invention is achieved by the following configurations.

(1) A terminal fitting is mounted on a terminal accommodation chamber formed in a connector housing by being engaged with an elastically deformable lance provided in the terminal accommodation chamber. The terminal fitting includes a bite resistance increasing part that is formed only at an upper portion of a hole edge engagement end face of an engaging hole to be engaged with the lance and increases a bite resistance to the lance. An lower portion of the hole edge engagement end face is flat. The bite resistance increasing part has a wave-shaped part that is formed by partially pressing the hole edge engagement end face.

According to the terminal fitting having a configuration of the above (1), as the terminal fitting is inserted into a predetermined position of the terminal accommodation chamber, the lance elastically returned is engaged with the engaging hole of the terminal fitting. A terminal engaging face of the lance engaged with the engaging hole is brought into contact with the hole edge engagement end face of the engaging hole. As an external force in a pull-out direction is exerted to the terminal fitting in an engaged state, the hole edge engagement end face is adapted to press the engaging part of the lance. At this time, since the bite resistance increasing part is formed on the hole edge engagement end face, a resisting force when the hole edge engagement end face bites into the lance is increased. In addition, even after the hole edge engagement end face bites into the lance, the resisting force is increased in such a manner that the bite resistance increasing part scratches a shearing surface, and a shearing surface area is also increased. In this way, a shear resistance is increased and therefore it is possible to increase the retaining force.

(2) A terminal fitting is mounted on a terminal accommodation chamber formed in a connector housing by being engaged with an elastically deformable lance provided in the terminal accommodation chamber. The terminal fitting includes a bite resistance increasing part that is formed both on an upper portion and an lower portion of a hole edge engagement end face of an engaging hole to be engaged with the lance. The bite resistance increasing part increases a bite resistance to the lance. The bite resistance increasing part has a wave-shaped part that is formed by partially pressing the upper portion and the lower portion of the hole edge engagement end face.

According to the terminal fitting having a configuration of the above (2), since the bite resistance increasing part is configured by the wave-shaped part that is formed by partially pressing the hole edge engagement end face, the bite resistance increasing part to increase the bite resistance to the lance or a shear resistance is easily formed.

(3) A terminal fitting is mounted on a terminal accommodation chamber formed in a connector housing by being engaged with an elastically deformable lance provided in the terminal accommodation chamber. The terminal fitting includes a bite resistance increasing part that is formed at a hole edge engagement end face of an engaging hole to be engaged with the lance. The bite resistance increasing part increases a bite resistance to the lance. The bite resistance increasing part is a rounded part that is formed by removing a corner part on the engaging side of the hole edge engagement end face.

According to the terminal fitting having a configuration of the above (3), since the rounded part is formed on the hole edge engagement end face, the rounded part is formed simultaneously when removing the corner part on the engaging side of the hole edge engagement end face in a non-processed state. In this way, since the corner part to promote biting is removed, it is possible to prevent the biting and the shear fracture from easily occurring.

DETAILED DESCRIPTION OF THE EXEMPLARY EMBODIMENTS

Hereinafter, a terminal fitting according to an illustrative embodiment of the present invention will be described with reference to the drawings.

Figure 1A:
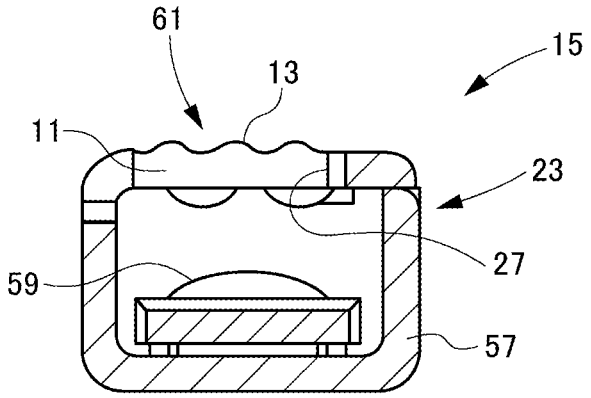
FIG. 1A is a sectional view showing a main part of a terminal fitting according to an illustrative embodiment of the present invention, in which a wave-shaped part is formed at an upper part of a hole edge engagement end face
Figure 1B:
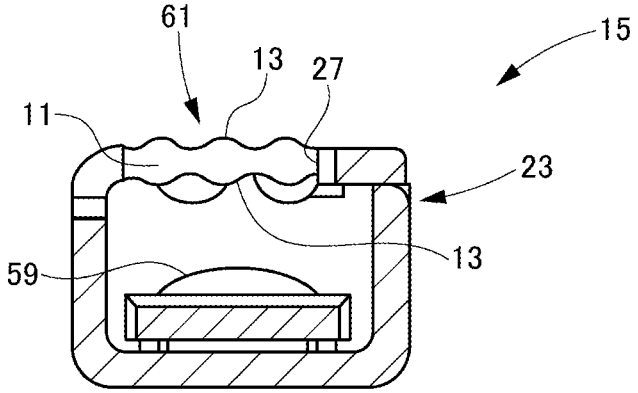
FIG. 1B is a sectional view showing a main part of a terminal fitting according to a modification of the illustrative embodiment, in which the wave-shaped parts are formed at an upper part and a lower part of the hole edge engagement end face.
Figure 2A:
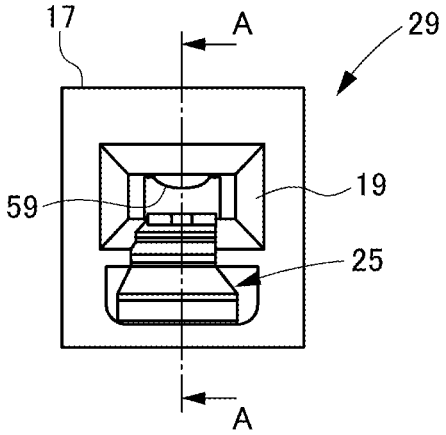
FIG. 2A is a front view showing a terminal receiving opening in a connector housing and FIG. 2B is a sectional view taken along a line A-A in FIG. 2A.
Figure 2B:
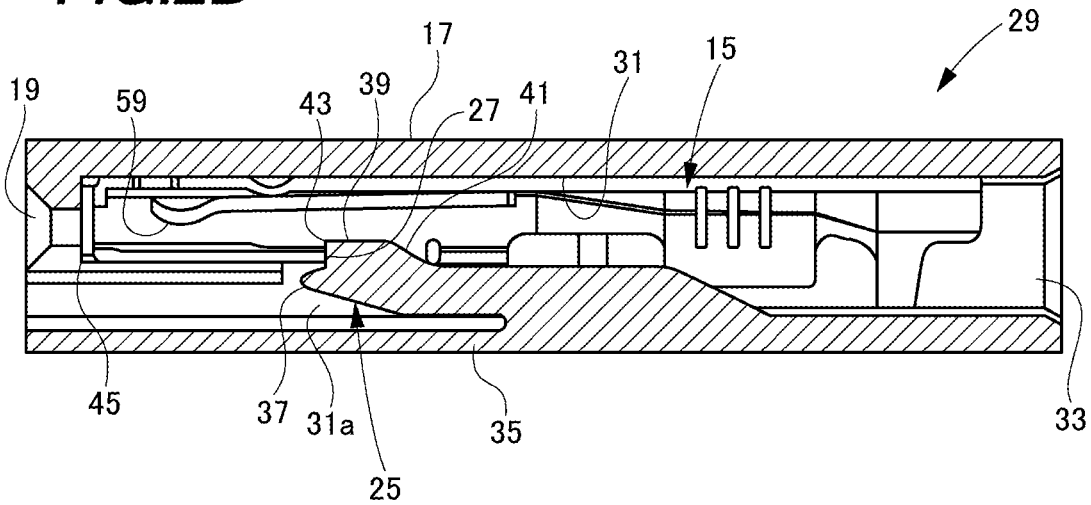
Figure 3A:
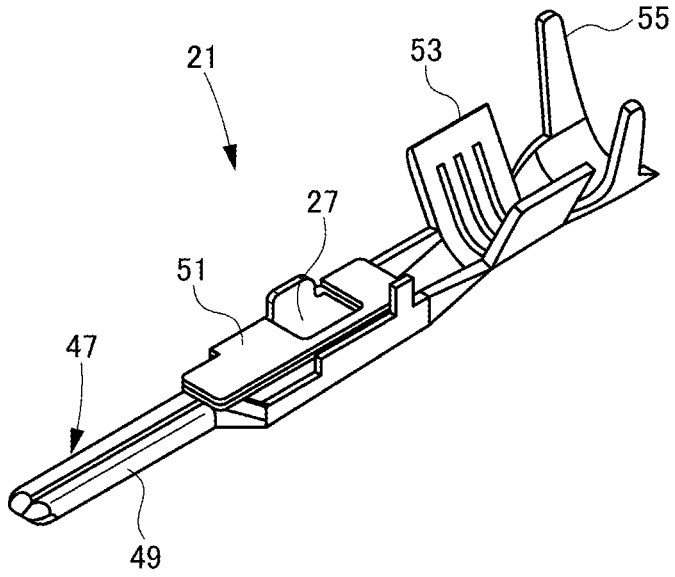
FIG. 3A is a perspective view showing a male terminal fitting and FIG. 3B is a perspective view showing a female terminal fitting.
Figure 3B:
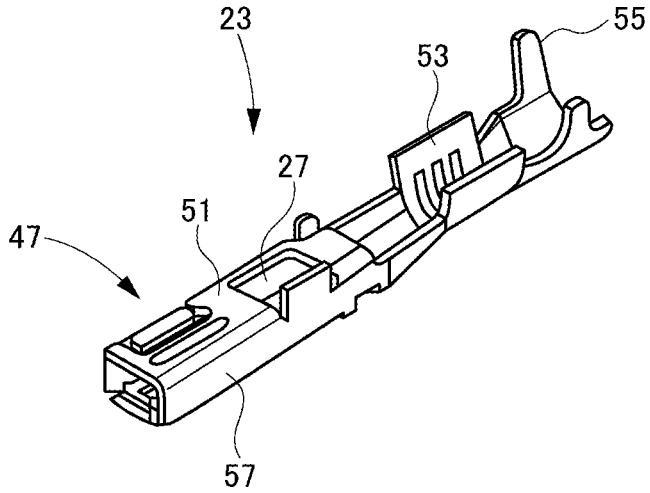

As shown in FIG. 1A to FIG. 2B, a terminal fitting 15 according to the present embodiment may be either a male terminal fitting 21 (see FIG. 3A) or a female terminal fitting 23 (see FIG. 3B). However, in either cases, it is essential that the terminal fitting 15 includes an engaging hole 27 with which a lance 25 is engaged.

As shown in FIG. 2A and FIG. 2B, in a connector 29 on which the terminal fitting 15 is mounted, a terminal receiving opening 19 for receiving a male terminal of a mating connector (not shown) is opened at one end face of a rectangular parallelepiped-shaped connector housing 17 in a longitudinal direction. The terminal receiving opening 19 is communicated with a terminal accommodation chamber 31 which is defined inside the connector housing 17. For the convenience of description, the terminal receiving opening 19 of the connector 29 is referred to as a front side and an opposite side thereof is referred to a rear side, as is used herein.

A female terminal fitting 15 is inserted into the terminal accommodation chamber 31 through a terminal mounting opening 33 which is opened to the rear of the connector housing 17. Here, the female terminal fitting 15 is merely illustrative and the terminal fitting 15 may be a male type. A lance 25 is protruded at a space on which the terminal fitting 15 is mounted. The lance 25 is formed integrally with the connector housing 17 from a synthetic resin material. A base end of the lance 25 is connected to a bottom wall 35 and a leading end thereof is a free end 37. The base end of the lance 25 is supported on the bottom wall 35 in a cantilever manner and thus the lance 25 is elastically deformable. A retreating space 31*a* is formed between a lower portion of the lance 25 and the bottom wall 35.

A convex part 39 is formed on an upper surface of the lance 25 near the free end 37. A rear section of the convex part 39 is a slanted surface 41 and a front section thereof is an engaging part 43. As the terminal fitting 15 is inserted, an electrical contact leading end 45 of the terminal fitting 15 abuts against the slanted surface 41 and thus a component force to push down the lance 25 toward the retreating space 31*a* occurs. When the lance 25 is elastically returned to its original position, the engaging part 43 is engaged with the engaging hole 27 of the terminal fitting 15 to prevent the terminal fitting 15 from being detached to the rear.

The male terminal fitting 21 shown in FIG. 3A is provided at its leading end with a male tab 49 which is an electrical contact part 47. Further, the male terminal fitting 21 is provided with a terminal body part 51, a conductor crimping part 53 and a sheath holding part 55, which are sequentially provided at the rear of the male tab. The male terminal fitting 21 is manufactured by sheet-metal processing of a metal plate.

Figure 5A:
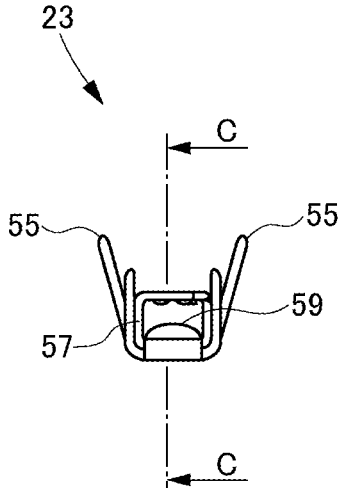
FIG. 5A is a front view showing the female terminal fitting and FIG. 5B is a sectional view taken along a line C-C in FIG. 5A.
Figure 5B:
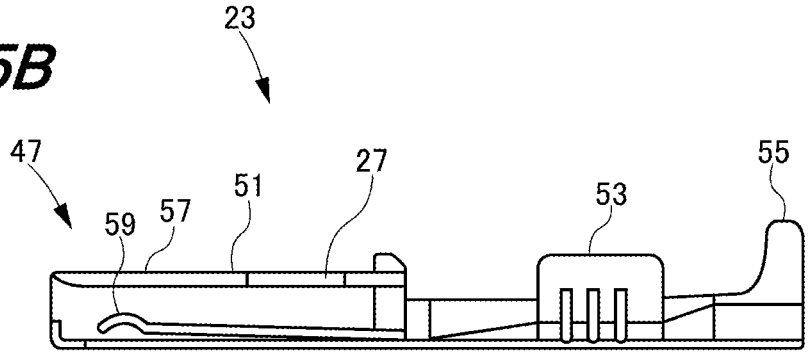

The female terminal fitting 23 shown in FIG. 3B is provided at its leading end with a box part 57 which is an electrical contact part 47 and receives a male tab of a mating terminal. And, a contact spring part 59 (see FIG. 5A and FIG. 5B) coming into contact with the male tab is provided inside the box part. Similar to the male terminal fitting 21, the female terminal fitting 23 is provided with a terminal body part 51, a conductor crimping part 53 and a sheath holding part 55, which are sequentially provided at the rear of the box part 57.

Figure 6:
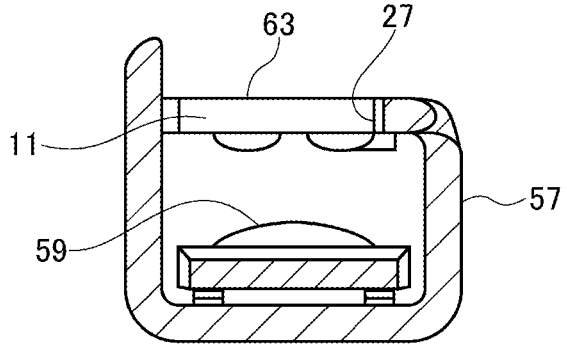
FIG. 6 is a sectional view showing a main part of a terminal fitting according to a comparative embodiment.

The terminal body part 51 of the male terminal fitting 21 and the female terminal fitting 23 is formed with the engaging hole 27 to be engaged with the lance 25. As shown in FIG. 3A and FIG. 3B, the engaging hole 27 has a rectangular shape. A front side of the engaging hole 27 constitutes a hole edge engagement end face 11. FIG. 1A and FIG. 1B illustrate the hole edge engagement end face 11 of the female terminal fitting 23 as a representative example. FIG. 1A and FIG. 1B are sectional views taken by cutting an approximately central portion of the engaging hole 27, showing a front side of the female terminal fitting 23. That is, FIG. 1A and FIG. 1B are front views of the hole edge engagement end face 11, as seen from the inside of the engaging hole 27. Rather than a flat shape of a comparative embodiment shown in FIG. 6, a bite resistance increasing part 61 to increase a bite resistance to the lance 25 is formed on the hole edge engagement end face 11.

Figure 4A:
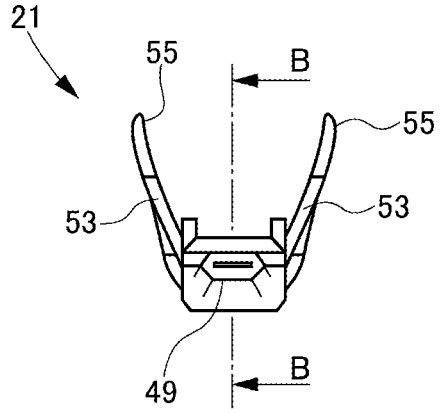
FIG. 4A is a front view showing the male terminal fitting and FIG. 4B is a sectional view taken along a line B-B in FIG. 4A.
Figure 4B:
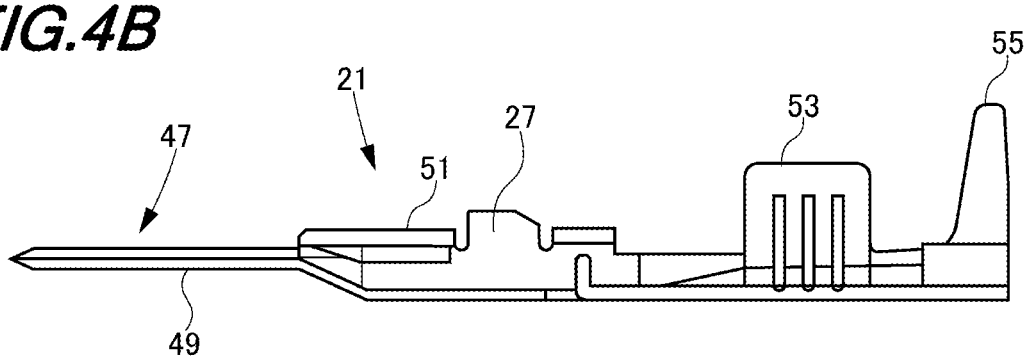

In the present embodiment, the bite resistance increasing part 61 is configured as a wave-shaped part 13 that is formed by partially pressing the hole edge engagement end face 11. The wave-shaped part 13 may be formed only at an upper part of the hole edge engagement end face 11, as shown in FIG. 1A or may be formed at both an upper part and a lower part of the hole edge engagement end face 11, as shown in FIG. 1B. A direction to press the hole edge engagement end face 11 may be a direction (an up-down direction in FIG. 1A and FIG. 1B) which is directed to the hole edge engagement end face 11 from the upper and lower, or a vertical direction (a left direction in FIG. 4B and FIG. 5B) which is directed to the hole edge engagement end face 11 from the inside of the engaging hole 27. In FIG. 1A, the lower part is flat. In FIG. 1B, both the upper part and the lower part of the hole edge engagement end face 11 are partially pressed. The upper part or both the upper part and the lower part are partially pressed to form a wave-shape in the hole edge engagement end face.

In FIG. 1A and FIG. 1B, a semi-circular bulging part formed at a lower part of the hole edge engagement end face 11 is an indent acting to increase the contact pressure of the contact spring 59 with the male tab of the mating terminal.

In the present embodiment, since the bite resistance increasing part 61 is configured by the wave-shaped part 13 that is formed by partially pressing the hole edge engagement end face 11, the bite resistance increasing part 61 to increase the bite resistance to the lance 25 or a shear resistance is easily formed.

Next, an operation of the terminal fitting 15 having the above configurations will be described.

As the terminal fitting 15 is inserted into a predetermined position of the terminal accommodation chamber 31, the lance 25 elastically returned is engaged with the engaging hole 27 of the terminal fitting 15. The engaging part 43 of the lance 25 engaged with the engaging hole 27 is brought into contact with the hole edge engagement end face 11 of the engaging hole 27. As an external force in a pull-out direction is exerted to the terminal fitting 15 in an engaged state, the hole edge engagement end face 11 is adapted to press the engaging part 43 of the lance 25.

That is, the lance 25 receives a reaction force from the hole edge engagement end face 11. At this time, in the case of the flat hole edge engagement end face 11 as in the terminal fitting of the comparative embodiment shown in FIG. 6, shear begins in a corner part 63 of the flat peripheral edge.

In the terminal fitting 15 according to the present embodiment, since the bite resistance increasing part 61 is formed on the hole edge engagement end face 11, a resisting force when the hole edge engagement end face 11 bites into the lance 25 is increased. In addition, even after the hole edge engagement end face bites into the lance, the resisting force is increased in such a manner that the bite resistance increasing part 61 scratches a shearing surface, and a shearing surface area can be also increased. In this way, a shear resistance is increased and therefore it is possible to increase the retaining force of the terminal fitting 15.

Next, another embodiment of the terminal fitting 15 according to the present invention will be described.

Figure 7A:
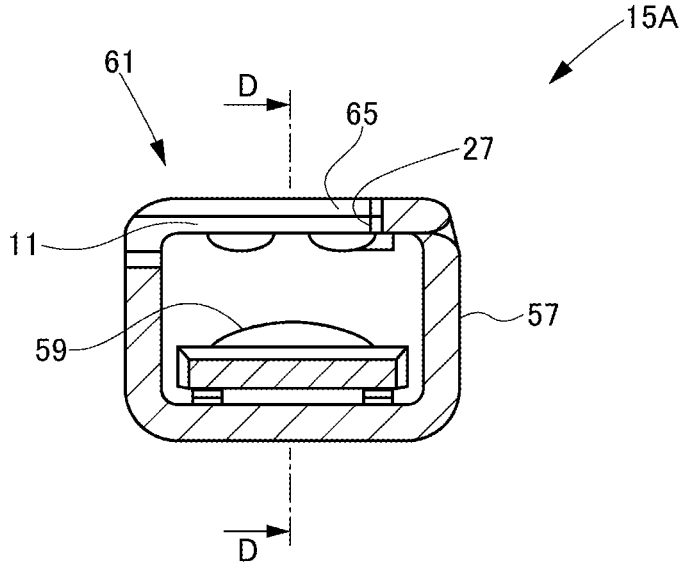
FIG. 7A is a sectional view showing a main part of a terminal fitting according to another embodiment, in which a rounded part is formed on the hole edge engagement end face
Figure 7B:
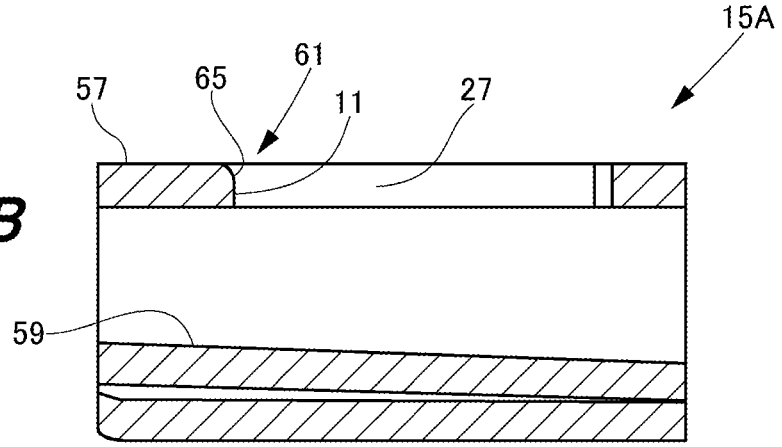
FIG. 7B is a sectional view taken along a line D-D in FIG. 7A.
Figure 8:
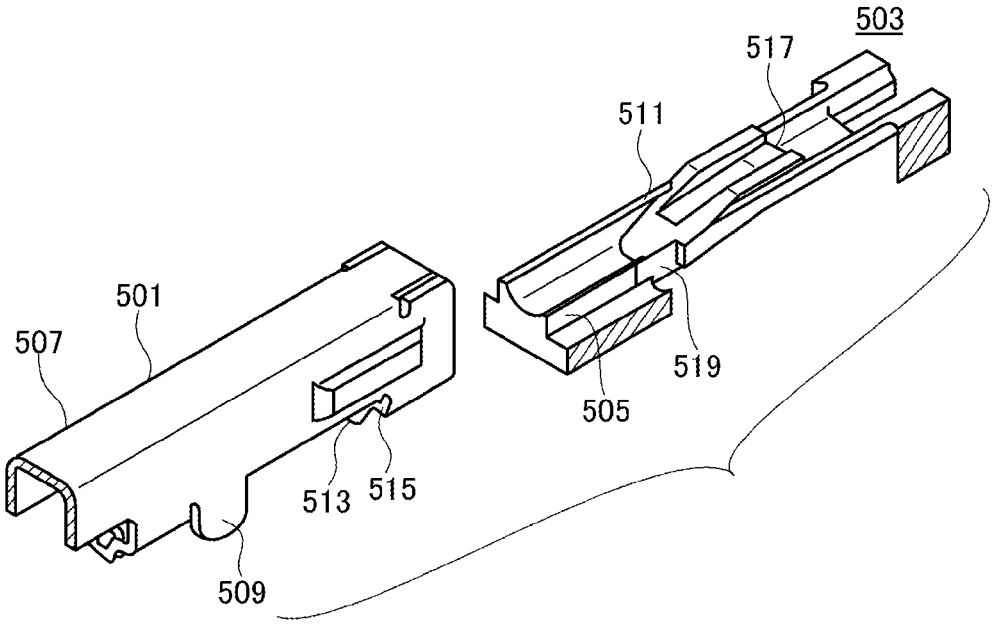
FIG. 8 is a perspective view showing a main part of a terminal fitting and a terminal accommodation chamber in a related art.

As shown in FIG. 7A and FIG. 7B, a terminal fitting 15A according to another embodiment is intended to increase the resistance when biting into the lance 25 by removing a pointed end face (that is, corner part 63). That is, the bite resistance increasing part 61 according to the present embodiment is a rounded part 65 that is formed by removing the corner part 63 on the engaging side of the hole edge engagement end face 11.

In this terminal fitting 15A, since the rounded part 65 is formed on the hole edge engagement end face 11, the rounded part 65 is formed simultaneously when removing the corner part 63 on the engaging side of the hole edge engagement end face 11 in a non-processed state. In this way, since the corner part 63 to promote biting is removed, it is possible to prevent the biting and the shear fracture from easily occurring.

Accordingly, according to the terminal fitting 15, 15A of the present embodiment, it is possible to suppress the increase of the possibility of shear fracture of the lance 25 due to compactness, and improving the retaining force.

Herein, the above-described illustrative embodiments merely illustrate the representative forms of the present invention and the present invention is not limited to the illustrative embodiments. That is, the illustrative embodiments can be variously modified without departing a spirit and a scope of the present invention.

Industrial Applicability

As described above, according to the terminal fitting of the present invention, it is possible to suppress the increase of the possibility of shear fracture of the lance due to compactness, thereby improving the retaining force.

REFERENCE SIGNS LIST

11: Hole Edge Engagement End Face
13: Wave-Shaped Part
15: Terminal Fitting
17: Connector Housing
25: Lance
27: Engaging Hole
31: Terminal Accommodation Chamber
61: Bite Resistance Increasing Part
63: Corner Part
65: Rounded Part

What is claimed is:

1. A terminal fitting mounted on a terminal accommodation chamber formed in a connector housing by being engaged with an elastically deformable lance provided in the terminal accommodation chamber, the terminal fitting comprising:

a bite resistance increasing part that is formed both on an upper portion and a lower portion of a hole edge engagement end face of an engaging hole to be engaged with the lance and increases a bite resistance to the lance, and the bite resistance increasing part has a wave-shaped part that is formed by partially pressing the hole edge engagement end face.

2. A terminal fitting mounted on a terminal accommodation chamber formed in a connector housing by being engaged with an elastically deformable lance provided in the terminal accommodation chamber, the terminal fitting comprising:

a bite resistance increasing part that is formed both on an upper portion and an lower portion of a hole edge engagement end face of an engaging hole to be engaged with the lance and increases a bite resistance to the lance, the bite resistance increasing part has a wave-shaped part that is formed by partially pressing the upper portion and the lower portion of the hole edge engagement end face.

* * * * *